US007452051B2

(12) United States Patent
Mihara et al.

(10) Patent No.: US 7,452,051 B2
(45) Date of Patent: Nov. 18, 2008

(54) INKJET RECORDING APPARATUS

(75) Inventors: Tohru Mihara, Ebina (JP); Hiroaki Satoh, Ebina (JP); Naoki Morita, Ebina (JP); Koichi Saitoh, Ebina (JP); Takamaro Yamashita, Ebina (JP); Masao Mashima, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 343 days.

(21) Appl. No.: 11/274,998

(22) Filed: Nov. 16, 2005

(65) Prior Publication Data

US 2006/0164459 A1 Jul. 27, 2006

(30) Foreign Application Priority Data

Jan. 24, 2005 (JP) ..... 2005-016100

(51) Int. Cl.
*B41J 2/165* (2006.01)

(52) U.S. Cl. ..... 347/22; 347/30; 347/32

(58) Field of Classification Search ..... 347/22–36; 346/22–36

See application file for complete search history.

(56) References Cited

U.S. PATENT DOCUMENTS 6,056,387 A * 5/2000 Kaneko ..... 347/23
6,099,116 A * 8/2000 Fujita et al. ..... 347/101
7,198,350 B2 * 4/2007 Nakashima ..... 347/23

FOREIGN PATENT DOCUMENTS

JP 2004-106359 4/2004

* cited by examiner

*Primary Examiner*—Stephen D Meier
*Assistant Examiner*—Ly T Tran
(74) *Attorney, Agent, or Firm*—Fildes & Outland, P.C.

(57) ABSTRACT

An inkjet recording apparatus conducts image recording by ejecting ink and a reactive liquid that reacts with the ink onto a recording medium conveyed by an endless conveyor component. The inkjet recording apparatus includes: a dummy ejection controller that dummy-ejects one of the ink and the reactive liquid onto a first position on the endless conveyor component and dummy-ejects the other of the reactive liquid and the ink onto a second position on the endless conveyor component where the one of the ink and the reactive liquid is not adherent; and a cleaning device that cleans the ink and the reactive liquid on the endless conveyor component.

11 Claims, 5 Drawing Sheets

INKJET RECORDING APPARATUS

CROSS-REFERENCE TO RELATED APPLICATION

This application claims priority under 35 USC 119 from Japanese Patent Application No. 2005-016100, the disclosure of which is incorporated by reference herein.

BACKGROUND OF THE INVENTION

1. Field of the Invention

The present invention relates to an inkjet recording apparatus that implements dummy ejection (preliminary ejection that is conducted in order to suppress the clogging of nozzles resulting from ink coagulation) on an endless conveyor component such as a conveyor belt.

2. Description of the Related Art

It is necessary to implement dummy ejection, which is conducted in order to suppress the clogging of nozzles resulting from ink coagulation, in inkjet recording apparatus that conduct image recording using ink and a reactive liquid that reacts with the ink, just as in inkjet recording apparatus that do not use a reactive liquid. As the reactive liquid, there are processing liquids for promoting ink fixing and improving image density and water resistance, and inks that react with the ink, suppress the spread of the color material and suppress bleeding.

Japanese Patent Application Publication (JP-A) No. 2004-106359 discloses, in an inkjet recording apparatus that uses ink and a reactive liquid, a configuration that conducts dummy ejection in regard to the ink and the reactive liquid. In this publication, a preliminary ejection liquid reservoir for storing processing liquid is disposed adjacent to a conveyor belt, the ink is ejected onto the conveyor belt, and the processing liquid is ejected into the preliminary ejection liquid reservoir.

However, in JP-A No. 2004-106359, the number of parts increases because the preliminary ejection liquid reservoir is separately disposed.

Further, in an inkjet recording apparatus disposed with a long printhead that prints on a recording medium conveyed by an endless conveyor component such as a conveyor belt, it is difficult to evacuate the long printhead. Also, from the standpoint of not dropping the printing speed, it is necessary to conduct dummy ejection on the endless conveyor component.

However, when the ink and the reactive liquid that reacts with the ink are dummy-ejected simultaneously onto the same position on the endless conveyor component, a reaction occurs on the endless conveyor component, and cleaning becomes difficult.

SUMMARY OF THE INVENTION

In view of this circumstance, the present invention provides an inkjet recording apparatus that can easily clean the ink and the liquid that reacts with the ink dummy-ejected onto the endless conveyor component.

A first aspect of the invention provides an inkjet recording apparatus that conducts image recording by ejecting ink and a reactive liquid that reacts with the ink onto a recording medium conveyed by an endless conveyor component, the inkjet recording apparatus including: a dummy ejection controller that dummy-ejects one of the ink and the reactive liquid onto a first position on the endless conveyor component and dummy-ejects the other of the reactive liquid and the ink onto a second position on the endless conveyor component where the one of the ink and the reactive liquid is not adherent; and a cleaning device that cleans the ink and the reactive liquid on the endless conveyor component.

BRIEF DESCRIPTION OF THE DRAWINGS

An embodiment of the present invention will be described in detail based on the following figures, wherein.

DETAILED DESCRIPTION OF THE INVENTION

An embodiment pertaining to an inkjet printer (inkjet recording apparatus) 10 of the present invention will be described on the basis of FIGS. 1 to 5C.

First, the overall configuration of the inkjet printer 10 will be described. The schematic configuration of the inkjet printer 10 pertaining to the present embodiment is shown in FIG. 1.

Figure 1:
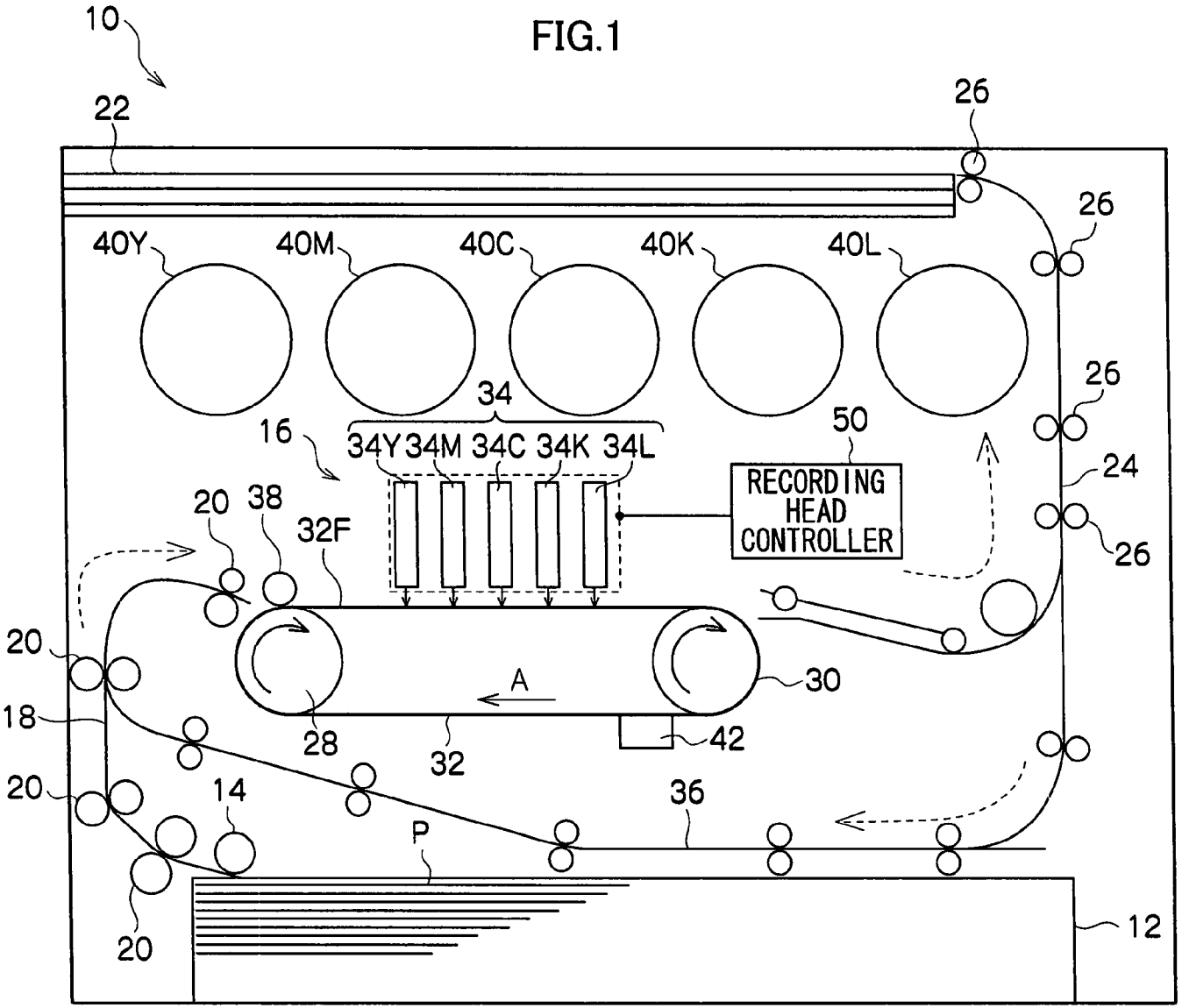
FIG. 1 is a schematic diagram showing an inkjet printer pertaining to the embodiment of the invention.

As shown in FIG. 1, the inkjet printer 10 is disposed with a paper supply cassette 12 in which paper (recording media) P is accommodated. A feed roll 14 that pressingly contacts the leading end portion of the upper surface of the paper P and removes the paper P from the paper supply cassette 12 is disposed on the upper portion of the leading end side (the left end side in FIG. 1) of the paper supply cassette 12.

The inkjet printer 10 includes a first conveyance path 18 that extends from the leading end portion of the paper supply cassette 12 and leads to a recording section 16, which conducts image recording on the paper P. Plural first conveyance roller pairs 20 that nip and convey the paper P to the recording section 16 are disposed on the first conveyance path 18.

The inkjet printer 10 also includes a second conveyance path 24 that extends upward from the recording section 16 and leads to a paper discharge tray 22, which accommodates the paper P on which an image has been recorded. Plural second conveyance roller pairs 26 that convey the paper P to the paper discharge tray 22 are disposed on the second conveyance path 24. An inverse conveyance path 36 for conducting two-sided printing connects the second conveyance path 24 to the first conveyance path 18.

According to the above configuration, the paper P is removed from the paper supply cassette 12 by the feed roll 14, conveyed on the first conveyance path 18 by the plural conveyance roller pairs 20, and fed to the recording section 16, where image recording is conducted. When an image has been recorded on the paper P, the paper P is conveyed on the second conveyance path 24 by the plural conveyance roller pairs 26 and discharged into the paper discharge tray 22. When two-sided printing is to be conducted, an image is first recorded on one side of the paper P, and then the paper P is conveyed from the second conveyance path 24 to the first conveyance path 18 via the inverse conveyance path 36 and is again fed to the recording section 16, where image recording is conducted on the other side of the paper P. Thus, successive image recording is conducted.

Next, the configuration of the recording section 16 will be described.

The recording section 16 includes an endless conveyor belt (endless conveyor component) 32 that is wound around a drive roller 28 disposed upstream in the paper conveyance direction and a driven roller 30 disposed downstream in the paper conveyance direction. The conveyor belt 32 is configured such that it is circulatingly driven (rotated) in the direction of arrow A in FIG. 1 (in a clockwise direction). A nip roller 38 that slidingly contacts the surface of the conveyor belt 32 is disposed on the upper portion of the drive roller 28.

An inkjet recording head 34 is disposed above the conveyor belt 32. The inkjet recording head 34 is configured to be long, such that its effective recording area is equal to or greater than the width of the paper P (the length of the paper P in the direction orthogonal to the conveyance direction). The inkjet recording head 34 includes four inkjet recording heads 34Y, 34M, 34C and 34K, which respectively correspond to the four colors of yellow (Y), magenta (M), cyan (C) and black (K), and a processing liquid ejection head 34L, which ejects processing liquid (reactive liquid). The inkjet recording heads 34Y, 34M, 34C and 34K and the processing liquid ejection head 34L are disposed along the conveyance direction; thus, the inkjet recording head 34 can record a full-color image. The processing liquid is used in order to promote ink fixing and improve image density and water resistance.

The inkjet recording head 34 faces a flat portion 32F of the conveyor belt 32, and this facing area serves as an ejection area to which ink droplets and the processing liquid are ejected from the inkjet recording head 34. The paper P conveyed on the first conveyance path 18 is retained by the conveyor belt 32 and sent to the ejection region, where the ink droplets and the processing liquid corresponding to image information are ejected from the inkjet recording head 34 onto the paper P in a state where the paper P faces the inkjet recording head 34.

Ink tanks 40Y, 40M, 40C and 40K, which supply the inks to the inkjet recording heads 34Y, 34M, 34C and 34K, and a processing liquid tank 40L, which supplies the processing liquid to the processing liquid ejection head 34L, are disposed above the inkjet recording head 34.

The inkjet recording heads 34Y, 34M, 34C and 34K and the processing liquid ejection head 34L are connected to a recording head controller 50. The recording head controller 50 controls the inkjet recording head 34 by determining the ejection timing of the ink droplets and the processing liquid, and the ink ejection ports (nozzles) to be used, in accordance with image information, and inputting a drive signal to the inkjet recording heads 34Y, 34M, 34C and 34K and the processing liquid ejection head 34L.

The recording head controller 50 also controls the ejection timing of the inkjet recording head 34, and the ink ejection ports (nozzles) to be used, when implementing dummy ejection (preliminary ejection that is conducted in order to suppress the clogging of nozzles resulting from ink coagulation).

A cleaning device 42, which is for cleaning the inks and the processing liquid adhering to the conveyor belt 32 when dummy ejection has been implemented on the conveyor belt 32, is disposed in the vicinity of the driven roller 30. The inks and the processing liquid adhering to the conveyor belt 32 are cleaned by the cleaning device 42 immediately after the conveyor belt 32 rotates and passes around the driven roller 30.

The cleaning device 42 may include a felt roller that contacts the conveyor belt 32 and suctions up the inks and the processing liquid, or a blade that scrapes the inks and the processing liquid on the conveyor belt 32. The cleaning device 42 may be plurally disposed, such that separate cleaning devices 42 clean the inks and the processing liquid respectively.

Next, the procedure of dummy-ejecting the inks and the processing liquid will be described.

First, the recording head controller 50 determines the positions at which the inks and the processing liquid are to be dummy-ejected, which are positions on the conveyor belt 32 where the paper P is not present, for example, between sheets of the paper P conveyed by the conveyor belt 32. The dummy ejection positions of the inks and the processing liquid may each be at one place or at several places. The dummy ejection positions of the ink and the processing liquid may also be at different positions on the conveyor belt 32 or at the same position.

Figure 2:
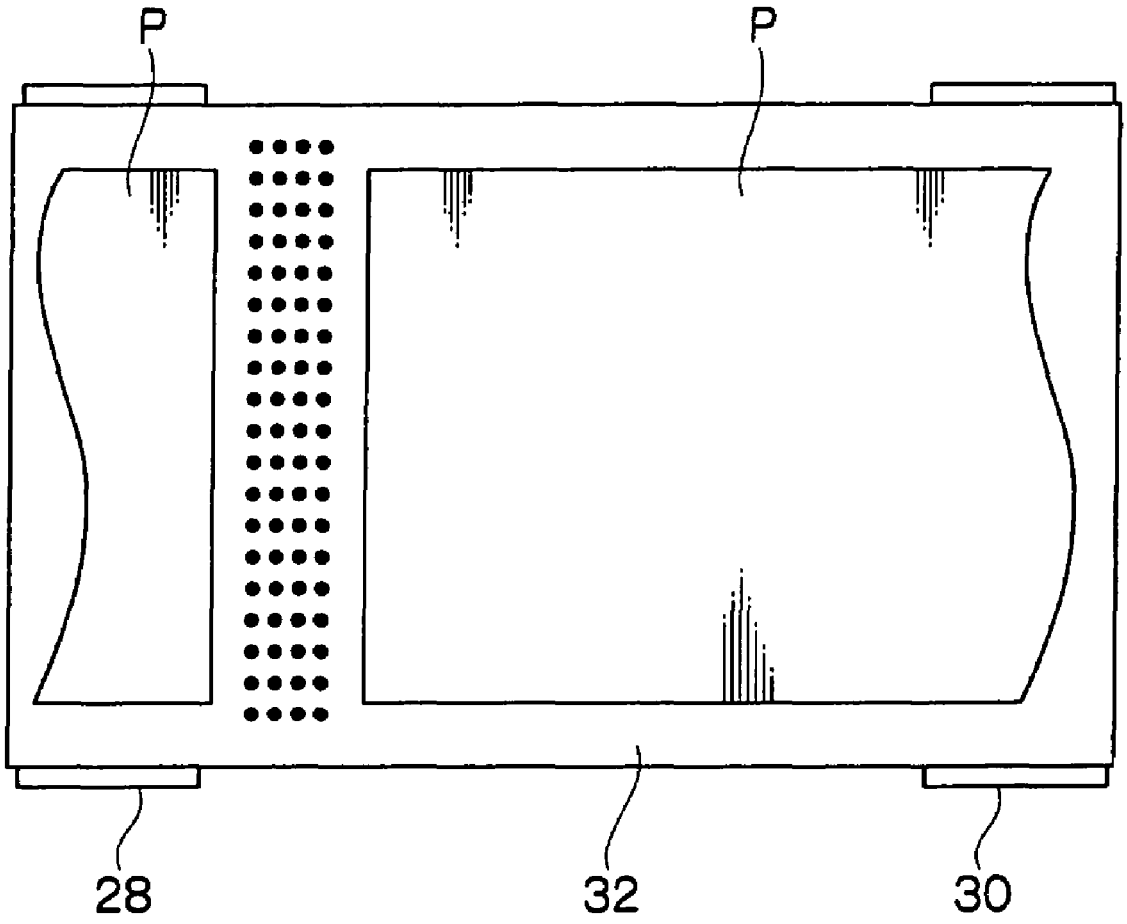
FIG. 2 is a diagram showing the dummy ejection of ink pertaining to the embodiment.

Next, as shown in FIG. 2, dummy ejection of the inks of the four colors is implemented at the dummy ejection positions on the conveyor belt 32. At this time, dummy ejection of the processing liquid is not implemented. The inks dummy-ejected onto the conveyor belt 32 are cleaned by the cleaning device 42 when that portion of the conveyor belt 32 reaches the cleaning device 42.

Figure 3:
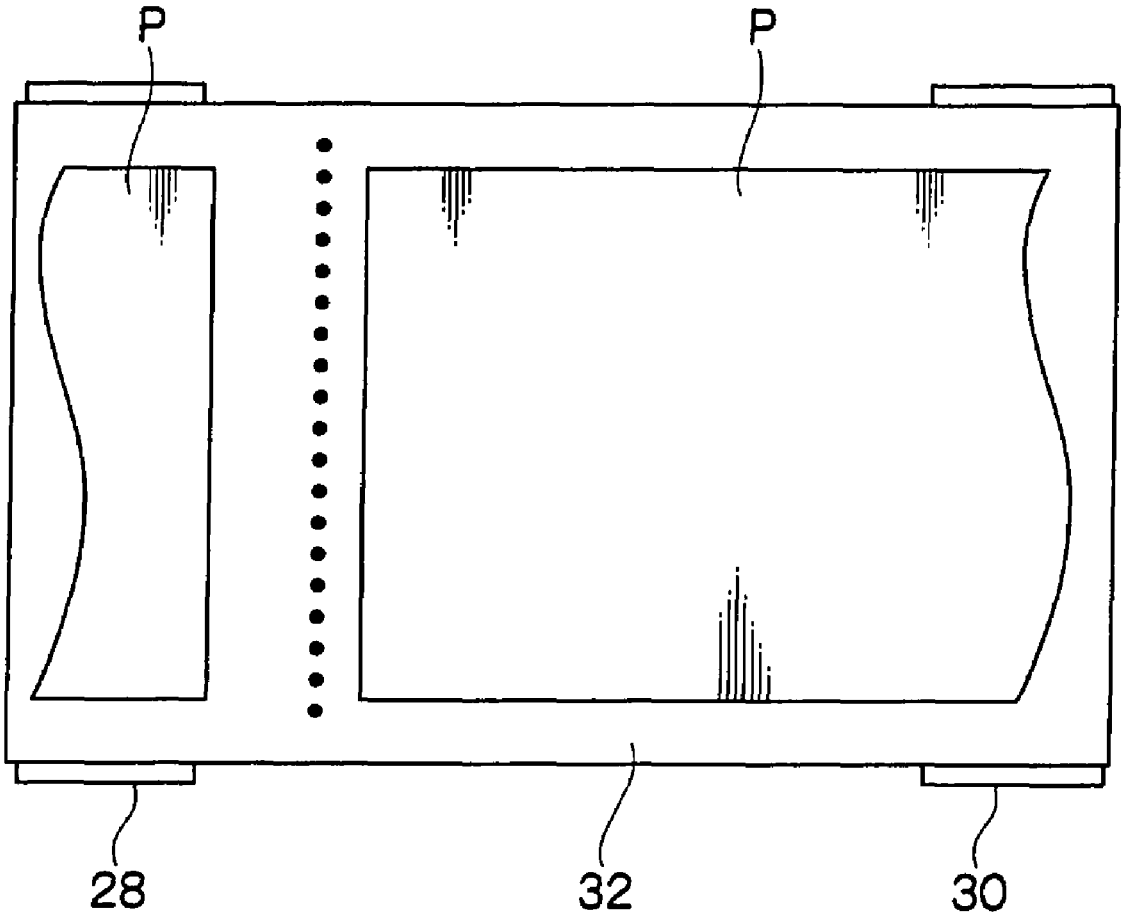
FIG. 3 is a diagram showing the dummy ejection of processing liquid pertaining to the embodiment.

After the cleaning, as shown in FIG. 3, dummy ejection of the processing liquid is implemented at the dummy ejection position on the conveyor belt 32. At this time, dummy ejection of the inks is not implemented. The processing liquid dummy-ejected onto the conveyor belt 32 is cleaned by the cleaning device 42 when that portion of the conveyor belt 32 reaches the cleaning device 42. After the cleaning, dummy ejection of the inks is again implemented, and thereafter the same action is conducted.

The dummy ejection of the processing liquid may be implemented before the dummy-ejected inks are cleaned. However, in this case, dummy ejection is conducted by selecting a dummy ejection position that is different from the dummy ejection positions of the inks.

In this case, the dummy ejection positions of the inks and the dummy ejection position of the processing liquid may be between the same sheets of paper or between different sheets of the paper P. When the positions are between the same sheets of the paper P, the interval between the other sheets of the paper P on the conveyor belt 32 can be reduced. Thus, more sheets of the paper P can be placed on the conveyor belt 32, and the through-put (printing speed) is improved. When the positions are between different sheets of the paper P, the distance between the inks and the processing liquid adhering to the conveyor belt 32 can be increased. For this reason, the potential for the inks or the processing liquid to move so that they come into contact with each other on the conveyor belt 32 can be reduced, and the potential for poor cleaning to arise can be reduced.

As described above, the inkjet printer 10 of the present embodiment implements dummy ejection of the processing liquid at a dummy ejection position on the conveyor belt 32 where the dummy-ejected inks are not adherent.

According to this configuration, the inks and the processing liquid do not become mixed together and do not react. Consequently, the dummy-ejected inks and processing liquid can be easily cleaned.

Because cleaning can be simplified with just a simple procedure in this manner, no other equipment is required, and a dummy ejection cleaning mechanism that does not have conventional processing liquid can be used as is. Moreover, there is no reduction in the printing speed because the dummy ejection and the cleaning can be implemented even during printing.

For example, in the case of an inkjet printer 10 where three sheets of the paper P can be placed on the conveyor belt 32 and where the printing speed is 90 ppm (papers per minute), the conveyor belt 32 rotates once in two seconds. Thus, with respect to the timing for implementing the dummy ejection of the inks and the processing liquid, assuming one minute for the time intervals that do not cause nozzle clogging, the timing may be shifted and implemented once every thirty rotations.

In order to suppress the amount of ink ejected once from the plural nozzles when the inks are dummy-ejected, the embodiment of the invention may also be configured such that the plural nozzles are divided into groups and dummy ejection is implemented several times at different timings per group.

Figure 4A:
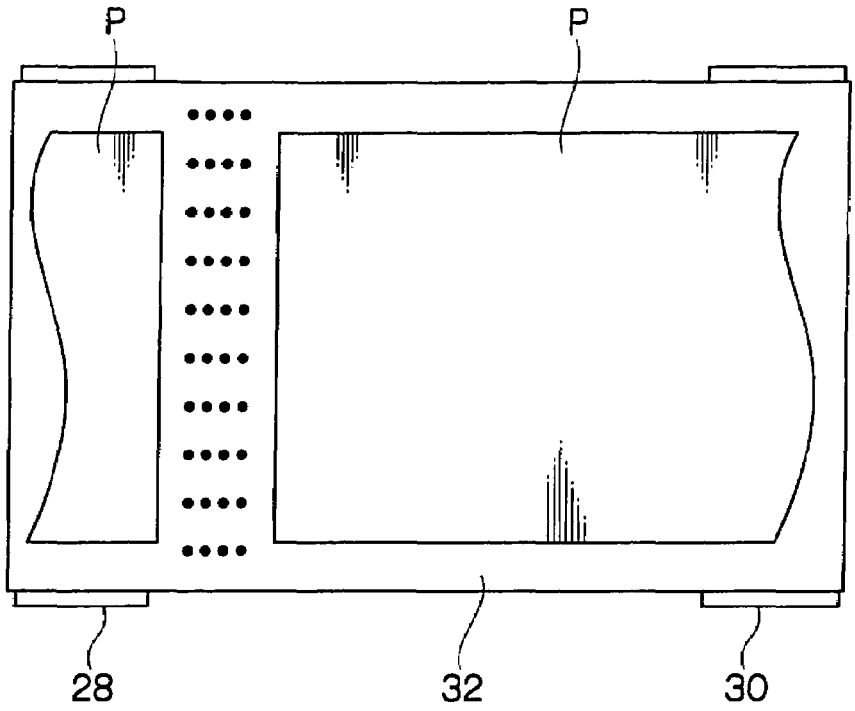
FIGS. 4A and 4B are diagrams showing a modified example of the dummy ejection of the ink pertaining to the embodiment.
Figure 4B:
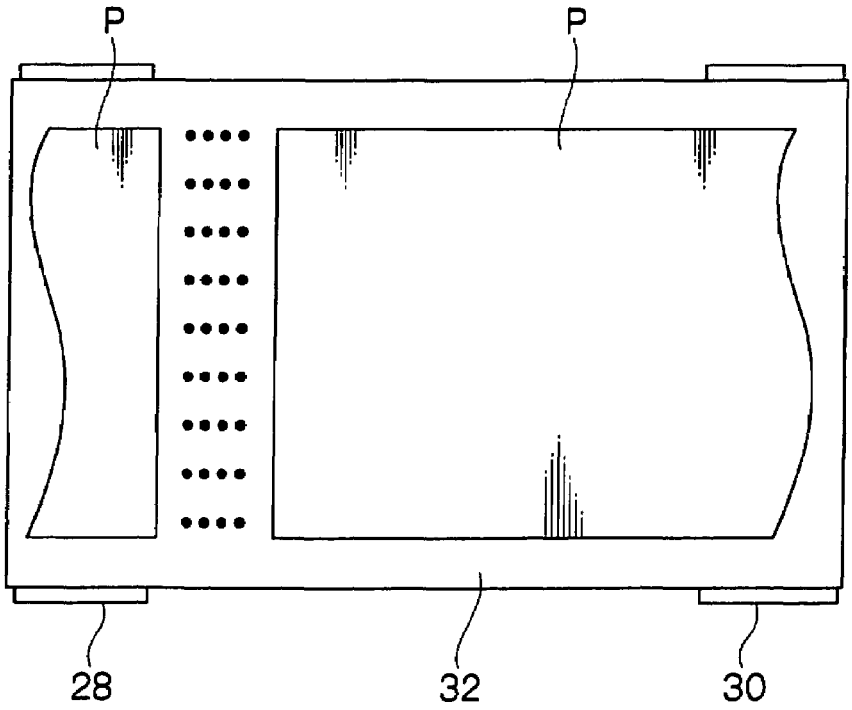

For example, the embodiment of the invention may be configured such that, first, just the odd-numbered nozzles dummy-eject the inks from the ends of the plural nozzles, as shown in FIG. 4A, and then during the next revolution, just the even-numbered nozzles dummy-eject the inks from the ends of the plural nozzles, as shown in FIG. 4B.

Figure 5A:
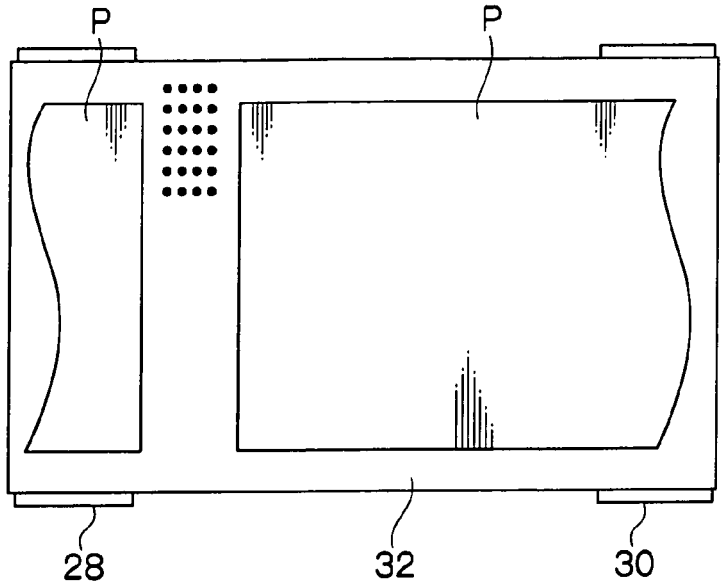
FIGS. 5A to 5C are diagrams showing a modified example of the dummy ejection of the ink pertaining to the embodiment.
Figure 5B:
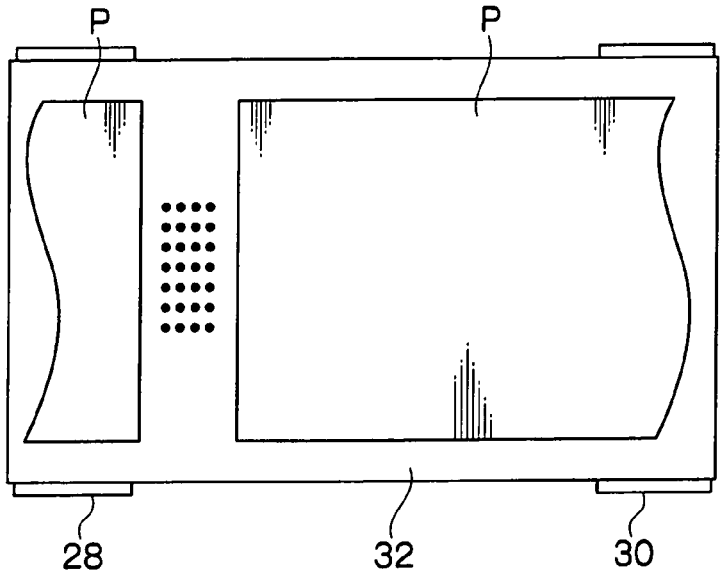
Figure 5C:
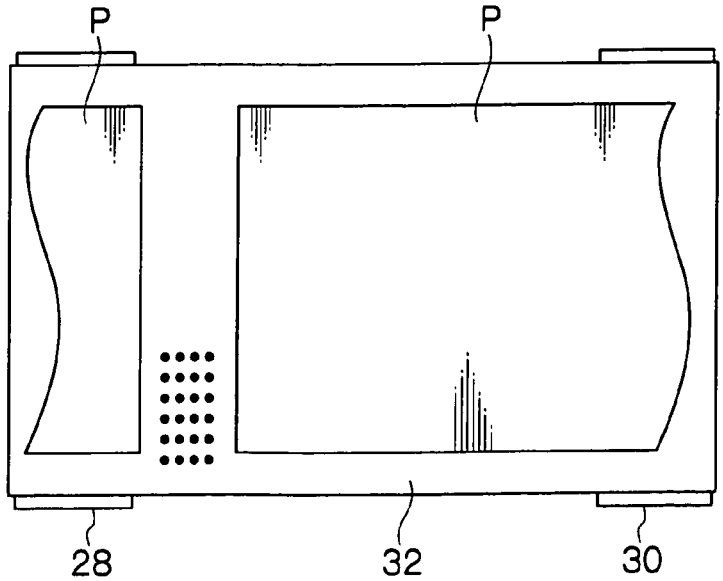

As shown in FIGS. 5A to 5C, the embodiment of the invention may also be configured such that the nozzles are divided into blocks and dummy ejection is implemented per block. For example, the embodiment of the invention may be configured such that, first, a first block implements dummy ejection, as shown in FIG. 5A, and then during the next revolution, a second block implements dummy ejection, as shown in FIG. 5B, and then during the next revolution, a third block implements dummy ejection, as shown in FIG. 5C. Dummy ejection may also be implemented by several times per color.

By configuring the embodiment of the invention in this manner, the amount of ink ejected at one time can be suppressed, and the amount of ink per unit area ejected onto the conveyor belt 32 can be reduced. For this reason, the dispersal (mist) of the inks and the reactive liquid can be suppressed, and the electrical power used at one time at the time of the ejection can be suppressed.

The frequency at which the dummy ejection of the inks and the processing liquid is implemented may be the same ratio, but when the speed at which the processing liquid coagulates is slow due to the diameters of the nozzles being large, for example, the speed at which dummy ejection of the processing liquid is implemented may be lower than the speed at which dummy ejection of the inks is implemented. By configuring the embodiment of the invention in this manner, useless implementation of the dummy ejection of the processing liquid can be reduced.

As described above, the inkjet recording apparatus pertaining to the embodiment of the invention implements dummy ejection of processing liquid at a dummy ejection position on the conveyor belt 32 where the dummy-ejected inks are not adherent.

The dummy ejection controller may be configured to dummy-eject the other of the ink and the reactive liquid onto the second position after cleaning, with the cleaning device, the one of the ink and the reactive liquid dummy-ejected onto the first position on the endless conveyor component.

In this case, the first position and the second position may be different positions or the same position.

According to this configuration, even if the ink and the reactive liquid are ejected onto the same position on the endless conveyor component, they do not become mixed together and do not react. Consequently, the dummy-ejected ink and the liquid that reacts with the ink can be easily cleaned.

In the inkjet recording apparatus, the first position and the second position may be both in an area between the same recording media conveyed by the endless conveyor component.

In the inkjet recording apparatus, the first position and the second position may be respectively in areas between different recording media conveyed by the endless conveyor component.

In the inkjet recording apparatus, the dummy ejection controller may be configured to dummy-eject the other of the ink and the reactive liquid onto the second position before cleaning, with the cleaning device, the one of the ink and the reactive liquid dummy-ejected onto the first position on the endless conveyor component.

The inkjet recording apparatus may further include plural nozzles that eject the ink and the reactive liquid, and the dummy ejection controller may be configured to cause at least one nozzle of the plural nozzles to conduct dummy ejection at a predetermined timing, and to cause a nozzle other than the at least one nozzle of the plural nozzles to conduct dummy ejection after the predetermined timing.

The inkjet recording apparatus may further include plural nozzles that eject the ink and the reactive liquid, and the dummy ejection controller may be configured to divide the plural nozzles into plural groups and cause each group to conduct dummy ejection at different timings.

According to this configuration, the ink and the reactive liquid ejected from the plural nozzles are dummy-ejected plural times. For this reason, the amounts of ink and reactive liquid ejected at one time can be suppressed. Thus, the dispersal of the ink and the reactive liquid can be suppressed, and the electrical power used at one time at the time of the ejection can be suppressed.

The frequency at which the dummy ejection of the reactive liquid is implemented may be lower than that of the ink.

Due to differences such as the nozzle diameters of the nozzles from which the ink and the reactive liquid are discharged, ordinarily it is more difficult for the reactive liquid to coagulate than for the ink to coagulate. For this reason, useless implementation of the dummy ejection can be reduced by making the frequency at which the reactive liquid is dummy-ejected smaller than that of the ink.

The cleaning devices may be plurally disposed, and the plural cleaning devices may be configured to separately clean the ink and the reactive liquid.

According to this configuration, the ink and the reactive liquid do not react inside the cleaning devices. For this reason, because the ink and the reactive liquid do not coagulate, the cleaning power of the cleaning devices does not deteriorate.

The reactive liquid that reacts with the ink may be processing liquid for promoting ink fixing and improving image density and water resistance. The reactive liquid may be an ink of a color different from that of the ink. For example, inks that react with the ink and suppress the spread of the color material and bleeding are included.

Because the embodiment of the invention is configured as described above, it can easily clean the ink and the liquid that reacts with the ink that are dummy-ejected onto the endless conveyor component.

The present invention is not limited to the preceding embodiment; various modes are possible.

For example, in the preceding embodiment, a conveyor belt was described as the endless conveyor component, but a conveyance-use drum may also be used as the endless conveyor component.

Also, in the preceding embodiment, an inkjet printer of the type that uses inks and processing liquid was described, but an inkjet printer that uses an ink for reacting with the ink, suppresses the spread of the color material and suppresses bleeding can be implemented in the same manner.

As this inkjet printer, a configuration is conceivable which causes yellow and black inks, which are a combination where bleeding is conspicuous, to react and suppress bleeding.

In this case also, dummy ejection is implemented by the same procedure as the procedure in the case of the inks and the processing liquid. (For example, yellow ink may be used as the ink in the above procedure, and black ink may be used as the processing liquid.) Thus, it can be ensured that the yellow and black inks do not react, and the dummy-ejected yellow and black inks can be easily cleaned.

What is claimed is:

1. An inkjet recording apparatus that conducts image recording by ejecting ink and a reactive liquid that reacts with the ink onto a recording medium conveyed by an endless conveyor component, the inkjet recording apparatus comprising:

a dummy ejection controller that dummy-ejects one of the ink and the reactive liquid onto a first position on the endless conveyor component and dummy-ejects the other of the reactive liquid and the ink onto a second position on the endless conveyor component where the one of the ink and the reactive liquid is not adherent; and a cleaning device that cleans the ink and the reactive liquid on the endless conveyor component.

2. The inkjet recording apparatus of claim 1, wherein the dummy ejection controller dummy-ejects the other of the ink and the reactive liquid onto the second position after cleaning, with the cleaning device, the one of the ink and the reactive liquid dummy-ejected onto the first position on the endless conveyor component.

3. The inkjet recording apparatus of claim 2, wherein the first position and the second position are the same position.

4. The inkjet recording apparatus of claim 1, wherein the first position and the second position are both in an area between the same recording media conveyed by the endless conveyor component.

5. The inkjet recording apparatus of claim 1, wherein the first position and the second position are respectively in areas between different recording media conveyed by the endless conveyor component.

6. The inkjet recording apparatus of claim 1, wherein the dummy ejection controller dummy-ejects the other of the ink and the reactive liquid onto the second position before cleaning, with the cleaning device, the one of the ink and the reactive liquid dummy-ejected onto the first position on the endless conveyor component.

7. The inkjet recording apparatus of claim 1, further comprising a plurality of nozzles that eject the ink and the reactive liquid, wherein the dummy ejection controller causes at least one nozzle of the plurality of nozzles to conduct dummy ejection at a predetermined timing, and causes a nozzle other than the at least one nozzle of the plurality of nozzles to conduct dummy ejection after the predetermined timing.

8. The inkjet recording apparatus of claim 1, further comprising plurality of nozzles that eject the ink and the reactive liquid, wherein the dummy ejection controller divides the plurality of nozzles into a plurality of groups and causes each group to conduct dummy ejection at different timings.

9. The inkjet recording apparatus of claim 1, wherein the frequency at which the dummy ejection of the reactive liquid is implemented is lower than that of the ink.

10. The inkjet recording apparatus of claim 1, wherein the cleaning device is plurally disposed, and the plurally disposed cleaning devices separately clean the ink and the reactive liquid.

11. The inkjet recording apparatus of claim 1, wherein the reactive liquid is an ink of a color different from that of the ink.

* * * * *